US005987413A

United States Patent [19]

Dutoit et al.

[11] Patent Number: 5,987,413

[45] Date of Patent: Nov. 16, 1999

[54] ENVELOPE-INVARIANT ANALYTICAL SPEECH RESYNTHESIS USING PERIODIC SIGNALS DERIVED FROM REHARMONIZED FRAME SPECTRUM

[76] Inventors: Thierry Dutoit, Rue Odon Rosier 15, Sirault, Belgium, B-7332; Vincent Pagel, Allee de Roches 3, Nancy, France, F-5400; Nicolas Pierret, Chemin d'Havre 23, Saint-Symphorien, Belgium, B-7030

[21] Appl. No.: 08/869,368

[22] Filed: Jun. 5, 1997

[51] Int. Cl.[6] ..... G10L 5/04; G10L 3/02

[52] U.S. Cl. ..... 704/267; 704/268; 704/278

[58] Field of Search ..... 704/260, 267, 704/268, 278

[56] References Cited

U.S. PATENT DOCUMENTS

| | | | |
|---|---|---|---|
| 5,327,498 | 7/1994 | Hamon | 704/268 |
| 5,369,730 | 11/1994 | Yajima | 704/267 |
| 5,524,172 | 6/1996 | Hamon | 704/268 |

FOREIGN PATENT DOCUMENTS

| | | |
|---|---|---|
| 0 527 527 A2 | 2/1993 | European Pat. Off. . |
| WO 90/03027 | 3/1990 | WIPO . |

OTHER PUBLICATIONS

Thierry Dutoit and H. Leich, "MBR–PSOLA: Text–to–Speech synthesis based on an MBE re–synthesis of the segments database," Speech Communication, vol. 13, pp. 435–440, Nov. 1993.

Thierry Dutoit and B. Gosselin, "On the use of a hybrid harmonic/stochastic model for TTS synthesis–by–concatentation", Speech Communication, Vo. 19, pp. 119–143, Aug. 1996.

Thierry Dutoit, "High Quality Text–to–Speech Synthesis: An Overview", J. Electrical and Electronics Engineering Australia, vol. 17, pp. 25–36, Mar. 1997.

E. Bryan George and Mark J. T. Smith, "Speech Analysis/Synthesis and Modification Using an Analysis–by–Synthesis/Overlap–Add Sinusoidal Model," IEEE Trans. Speech and Audio Processing, vol. 5, pp. 389–406, Sep. 1997.

Cox, R., et al. (1983) Real–Time implementation of time domain harmonic scaling of speech for rate modification and coding. IEEE Journal of Solid–State Circuits, vol. SC–18, No. 1, pp. 10–24.

Verhelst, W., et al. (1993) An overlap–add technique based on waveform similarity (WSOLA) for high quality time–scale modification of speech. International Conference on Acoutics, Speech and Signal Processing vol. 2 27–30, Minneapolis, MN pp. 554–557.

Yazu, T., et al. (1986) The Speech synthesis system for an umlimited japanese vocabulary. International Conference on Acoustics, Speech and Signal Processing, vol. 3, 7, Tokyo, JP pp. 2019–2022.

*Primary Examiner*—David R. Hudspeth
*Assistant Examiner*—Tālivaldis Ivars Šmits
*Attorney, Agent, or Firm*—Knobbe, Martens, Olson & Bear, LLP

[57] ABSTRACT

Method envelope-invariant for audio signal synthesis from elementary audio waveforms stored in a dictionary wherein:

the waveforms are perfectly periodic, and stored as one of their period, synthesis is obtained by overlap-adding of the waveforms obtained from time-domain repetition of the periodic waveforms with a weighting window whose size is approximately two times the period of the signals to weight, and whose relative position inside of the period is fixed to any value identical for all the periods, each extracted from a reharmonized and thus periodic waveform, obtained by modifying, without changing the spectral envelope, the frequencies and amplitudes of harmonics in the spectrum of a frame of the original continuous speech waveform, whereby the time shift between two successive waveforms obtained by weighting the original signals is set to the imposed fundamental frequency of the signal to synthesize.

14 Claims, 3 Drawing Sheets

ENVELOPE-INVARIANT ANALYTICAL SPEECH RESYNTHESIS USING PERIODIC SIGNALS DERIVED FROM REHARMONIZED FRAME SPECTRUM

RELATED APPLICATIONS

This application claims priority to Belgian application Ser. No. 09600524, for METHOD FOR AUDIO SYNTHESIS, filed on Jun. 10, 1996.

BACKGROUND OF THE INVENTION

The invention described herein relates to a method of synthesis of audio sounds. To simplify the description, focus is mainly made on vocal sounds, keeping in mind that the invention can be applied to the field of music synthesis as well.

In the framework of the so-called "concatenative" synthesis techniques which are increasingly used, synthetic speech is produced from a database of speech segments. Segments may be diphones, for example, which begin from the middle of the stationary part of a phone (the phone being the acoustic realization of a phoneme) and end in the middle of the stationary part of the next phone. French, for instance, is composed of 36 phonemes, which corresponds to approximately 1240 diphones (as a matter of fact some combination of phonemes are impossible). Other types of segments can be used, like triphones, polyphones, half-syllables, etc. Concatenative synthesis techniques produce any sequence of phonemes by concatenating the appropriate segments. The segments are themselves obtained from the segmentation of a speech corpus read by a human speaker.

Two problems must be solved during the concatenation process in order to get a speech signal comparable to human speech.

The first problem arises from the disparities of the phonemic contexts from which the segments were extracted, which generally results in some spectral envelope mismatch at both ends of the segments to be concatenated. As a result, a mere concatenation of segments leads to sharp transitions between units, and to less fluid speech.

The second problem is to control the prosody of synthetic speech, i.e. its rhythm (phoneme and pause lengths) and its fundamental frequency (the vibration frequency of the vocal folds). The point is that the segments recorded in the corpus have their own prosody that does not necessarily correspond to the prosody imposed at synthesis time.

Hence there is a need to find a means of controlling prosodic parameters and of producing smooth transitions between segments, without affecting the naturalness of speech segments.

One distinguishes two families of methods to solve such problems: the ones that implement a spectral model of the vocal tract, and the ones that modify the segment waveforms directly in the time domain.

In the first family of synthesis methods, transitions between concatenated segments are smoothed out by computing the difference between the spectral envelopes on both sides of the concatenation point, and propagating this difference in the spectral domain on both segments. The way it controls the pitch and the duration of segments depends on the particular model used for spectral envelope estimation. All these methods require a high computational load at synthesis time, which prevents them from being implemented in real time on low-cost processors.

On the contrary the second family of synthesis methods aims to produce concatenation and prosody modification directly in the time domain with very limited computational load. All of them take advantage of the so-called "Poisson's Sum Theorem", well known among signal processing specialists which demonstrates that it is possible to build from any finite waveform with a given spectral envelope, an arbitrarily chosen (and constant) pitch. This theorem can be applied to the modification of the fundamental frequency of speech signals. Provided the spectrum of the elementary waveforms is close to the spectral envelope of the signal one wishes to modify, pitch can be imposed by setting the shift between elementary waveforms to the targeted pitch period, and by adding the resulting overlapping waveforms. In this second family, synthesis methods mainly differ in the way they derive elementary waveforms from the pre-recorded segments. However, in order to produce high-quality synthetic speech, the overlapping elementary waveforms they use must have a duration of at least twice the fundamental period of the original segments. Two classes of techniques in this second family of synthesis methods will be described hereafter.

The first class refers to methods hereafter referred to as 'PSOLA' methods (Pitch Synchronous Overlap Add), characterized by the direct extraction of waveforms from continuous audio signals. The audio signals used are either identical to the original signals (the segments), or obtained after some transformation of these original signals. Elementary waveforms are extracted from the audio signals by multiplying the signals with finite-duration weighting windows positioned synchronously with the fundamental frequency of the original signal. Since the size of the elementary waveforms must be at least twice the original period, and given that there is one waveform for each period of the original signal, the same speech samples are used in several successive waveforms: the weighting windows overlap in the audio signals.

Examples of such PSOLA methods are those defined in documents EP-0363233, U.S. Pat. No. 5,479,564, EP-0706170. A specific example is also the MBR-PSOLA method as published by T. Dutoit and H. Leich, in Speech Communication, Elsevier Publisher, November 1993, Vol. 13, N° 3–4, 1993. The method described in document U.S. Pat. No. 5,479,564 suggests a means of modifying the frequency of an audio signal with constant fundamental frequency by overlap-adding short-term signals extracted from this signal. The length of the weighting windows used to obtain the short-term signals is approximately equal to two times the period of the audio signal and their position within the period can be set to any value (provided the time shift between successive windows is equal to the period of the audio signal). Document U.S. Pat. No. 5,479,564 also describes a means of interpolating waveforms between segments to concatenate, so as to smooth out discontinuities. This is achieved by modifying the periods corresponding to the end of the first segment and to the beginning of the second segment, in such a way as to propagate the difference between the last period of the first segment and the first period of the second segment.

The second class of techniques, hereafter referred to as 'analytic', is based on a time-domain modification of elementary waveforms that do not share, even partially, their samples. The synthesis step still uses shifting and overlap-adding of the weighted waveforms carrying the spectral envelope information. These waveforms are no longer extracted from a continuous speech signal by means of overlapping weighting windows. Examples of these techniques are those defined in documents S. Vajma U.S. Pat. No. 5,369,730 and C. R. Lee, et al. BG 2261350 (also U.S.

Pat. No. 5,617,507), as well as by T. Yazu, K. Yamada, "The speech synthesis system for an unlimited Japanese vocabulary", in proceedings IEEE ICASSP 1986, Tokyo, pp. 2019–2022.

In all these 'analytic' techniques, the elementary waveforms are impulse responses of the vocal tract computed from evenly spaced speech signal frames, and resynthesized via a spectral model. The present invention falls in this class of methods, except that it uses different elementary waveforms, obtained by reharmonizing the envelope spectrum.

An advantage of analytic methods over PSOLA methods is that the waveforms they use result from a true spectral model of the vocal tract. Therefore, they can intrinsically model the instantaneous spectral envelope information with more accuracy and precision than PSOLA techniques, which simply weight a time-domain signal with a weighting window. Moreover, it is possible with analytic methods to separate the periodic (voiced) and aperiodic (unvoiced) components of each waveform, and modify their balance during the resynthesis step in order to modify the speech quality (soft, harsh, whispered, etc).

In practice, this advantage is counterbalanced by an increase of the size of the resynthesized segment database (typically a factor 2 since the successive waveforms do not share any samples while their duration still has to be equal to at least two times that of the pitch period of the audio signal). The method described by M M. Yazu and Yamada precisely aims at reducing the number of samples to be stored, by resynthesizing impulse responses in which the phases of the spectral envelope are set to zero. Only half of the waveform needs to be stored in this case, since phase zeroing results in perfectly symmetrical waveforms. The main drawback of this method is that it greatly affects the naturalness of the synthetic speech. It is well known, indeed, that producing significant phase distortion has a strong effect on speech quality.

Aim of the Invention

The present invention aims to suggest a method for audio synthesis that avoids the drawbacks presented in the state of the art and which requires limited storage for the waveforms while avoiding important distortions of the natural phase of acoustic signals.

Main Characteristic Elements of the Invention

The present invention relates to a method for audio synthesis from waveforms stored in a dictionary characterized by the following points:

- the waveforms are infinite and perfectly periodic, and are stored as one of their periods, itself represented as a sequence of sound samples of a priori of any length;
- Synthesis is carried out by overlapping and adding the waveforms multiplied by a weighting window whose length is approximately two times the period of the original waveform, and whose position relatively to the waveform can be set to any fixed value;

The time shift between two successive weighted signals obtained by weighting the original waveforms is equal to the fundamental period requested for the synthetic signal, whose value is imposed. This value may be lower or greater than that of the original waveforms.

The method according to the present invention, basically differs from any other 'analytic' method by the fact that the elementary waveforms used are not full impulse responses of the vocal tract, but infinite periodic signals, multiplied by a weighting window to keep their length finite, and carrying the same spectral envelope as the original audio signals. A spectral model (hybrid harmonic/stochastic model, for instance, although the invention is not exclusively related to any particular spectral model) is used for resynthesis in order to get periodic waveforms (instead of the symmetric impulse responses of M M. Yazu and Yamada) carrying instantaneous spectral envelope information. Because of the periodicity of the elementary waveforms produced, only the first period need to be stored. The sound quality obtained by this method is incomparably superior to the one of M M. Yazu and Yamada, since the computation of the periodic waveforms does not impose phase constraints on the spectral envelopes, thereby avoiding the related quality degradation.

The periods that need to be stored are obtained by spectral analysis of a dictionary of audio segments (e.g. diphones in the case of speech synthesis). Spectral analysis produces spectral envelope estimates throughout each segment. Harmonic phases and amplitudes are then computed from the spectral envelope and the target period (i.e. the spectral envelope is sampled with the targeted fundamental frequency).

The length of each resynthesis period can advantageously be chosen equal for all the periods of all the segments. In this particular case, classical techniques for waveform compression (e.g. ADPCM) allow very high compression ratios (about 8) with very limited computational cost for decoding. The remarkable efficiency of such techniques on the waveforms obtained mainly originates from the fact that:

- all the periods stored in the segment database have the same length, which leads to a very efficient period to period differential coding scheme;
- the use of a spectral model for spectral envelope estimation allows the separation of harmonic and stochastic components of the waveforms. When the energy of the stochastic component is low enough compared to that of the harmonic component, it may be completely eliminated, in which case only the harmonic component is resynthesized. This results in waveforms that are more pure, noiseless, and exhibit more regularity than the original signal, which additionally enhances the efficiency of ADPCM coding techniques.

To further enhance the efficiency of coding techniques, the phases of the lower-order (i.e., lower frequency) harmonics of each stored period may be fixed (one phase value fixed for each harmonic of the database) for the resynthesis step. The frequency band where this setting is acceptable ranges from 0 to approximately 3 kHz. In this case, the resynthesis operation results in a sequence of periods with constant length, in which the time-domain differences between two successive periods is mainly due to spectral envelope differences. Since the spectral envelope of audio signals generally changes slowly with time, given the inertia of the physical mechanisms that produce them, the shape of the periods obtained in this way also evolve slowly. This, in turn, is particularly efficient when it comes to coding signals on the basis of period to period differences.

Independently of its use for segment coding, the idea of imposing a set of fixed values for the phases of the lower frequency harmonics leads to the implementation of a temporal smoothing technique between successive segments, to attenuate spectral mismatch between periods. The temporal difference between the last period of the first segment and the first period of the second segment is computed, and smoothly propagated on both sides of the concatenation point with a weighting coefficient continuously varying from −0.5 to 0.5 (depending on which side of the concatenation point is processed).

It should be noted that although the efficient coding properties and smoothing capabilities mentioned above were already available in the MBR-PSOLA technique as described in the state of the art, their effect is drastically reinforced in the present invention as opposed to the waveforms used by MBR-PSOLA, the periods used here do not share any of their samples, allowing a perfect separation between harmonically purified waveforms, and waveforms that are mainly stochastic.

Finally, the present invention still makes it possible to increase the quality of the synthesized audio signal by associating, with each resynthesized segment (or 'base segment'), a set of replacement segments similar but not identical to the base segment. Each replacement segment is processed in the same way as the corresponding base segment, and a sequence of periods is resynthesized. For each replacement segment, for instance, one can keep two periods corresponding respectively to the beginning and the end of the replacement segment at synthesis time. When two segments are about to be concatenated, it is then possible to modify the periods of the first base segment so as to propagate, on the last periods of this segment, the difference between the last period of the base segment and the last period of one of its replacement segments. Similarly, it is possible to modify the periods of the second base segment so a to propagate, on the first periods of this segment, the difference between the first period of the base segment and the first period of one of its replacement segments. The propagation of these differences is simply performed by multiplying the differences by a weighting coefficient continuously varying from 1 to 0 (from period to period) and adding the weighted differences to the periods of the base segments.

Such a modification of the time-domain periods of a base segment so as to make it sound like one of its replacement segment can be advantageously used to produce free variants to a base sound, thereby avoiding the monotony resulting from the repeated use of a base sound. It can also be put to use for the production of linguistically motivated sound variants (e.g., stressed/unstressed vowels, tense/soft voice, etc.)

The fundamental difference between the method described in the state of the art, which according to our classification is a 'PSOLA' method, and the method of the present invention originates in the particular way of deriving the periods used. As opposed to the waveforms extracted from a continuous signal as proposed in the state of the art, the waveforms used in the present invention do not share any of their samples (hence, they do not overlap). It therefore benefits from the typical advantages of other analytic methods:

- very efficient coding techniques which account for the fact that:
  - periods can be harmonically purified by completely eliminating their stochastic component;
  - when resynthesizing periods, the phase of low-frequency harmonics can bet set constant (i.e., one fixed value for each harmonic throughout the segment database)
- Ability to produce sound variants by interpolating between base and replacement segments. For each base segment, for instance, two additional periods are stored, corresponding to the beginning and end of the segment and taken from a replacement segment. This enables the synthesis of more natural sound voices.

BRIEF DESCRIPTION OF THE DRAWINGS

The method according to the present invention shall be more precisely described by comparing it with the following state-of-the-art methods.

DESCRIPTION OF A PREFERRED EMBODIMENT OF THE INVENTION

Figure 1A:
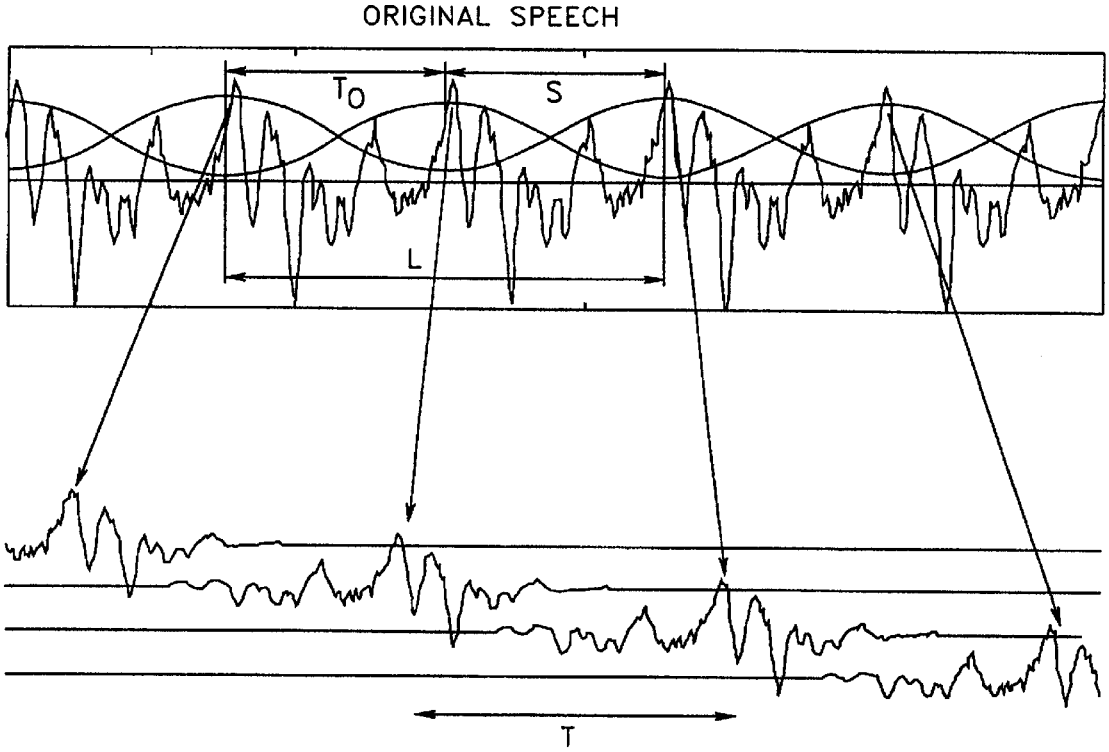
FIG. 1A (PRIOR ART)
FIG. 1 illustrates the different steps of speech synthesis according to a PSOLA method, FIG. 2 describes the different steps of speech synthesis according to the analytic method proposed by M M. Yazu and Yamada, FIG. 3 describes the different steps of speech synthesis in accordance to the present invention.
Figure 1B:
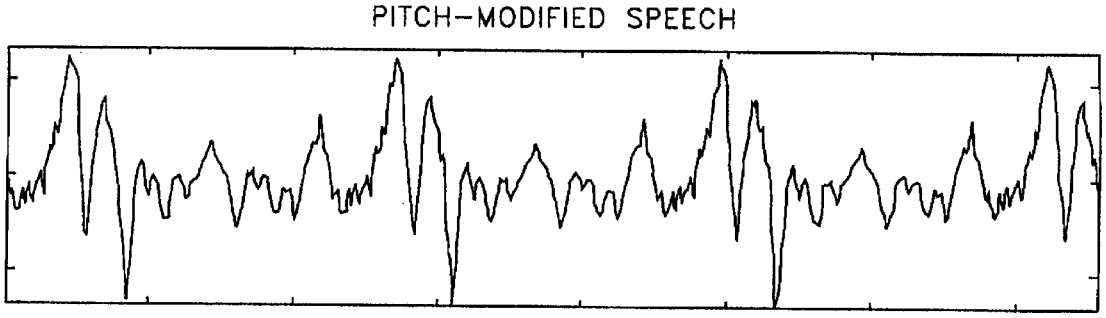
FIG. 1B (PRIOR ART)

FIG. 1 shows a classical representation of a PSOLA method characterized by the following steps:

1. At least on the voiced parts of speech segments, an analysis is performed by weighting speech with a window approximately centered on the beginning of each impulse response of the vocal tract excited by the vocal folds. The weighting window has a shape that decreases down to zero at its edges, and its length is at least approximately two times the fundamental period of the original speech, or two times the fundamental period of the speech to be synthesized.
2. The signals that result from the weighting operation are shifted from each other, the shift being adjusted to the fundamental period of the speech to be synthesized, lower or greater than the original one, following the prosodic information related to the fundamental period at synthesis time.
3. Synthetic speech is obtained by summing these shifted signals.

Figure 2A:
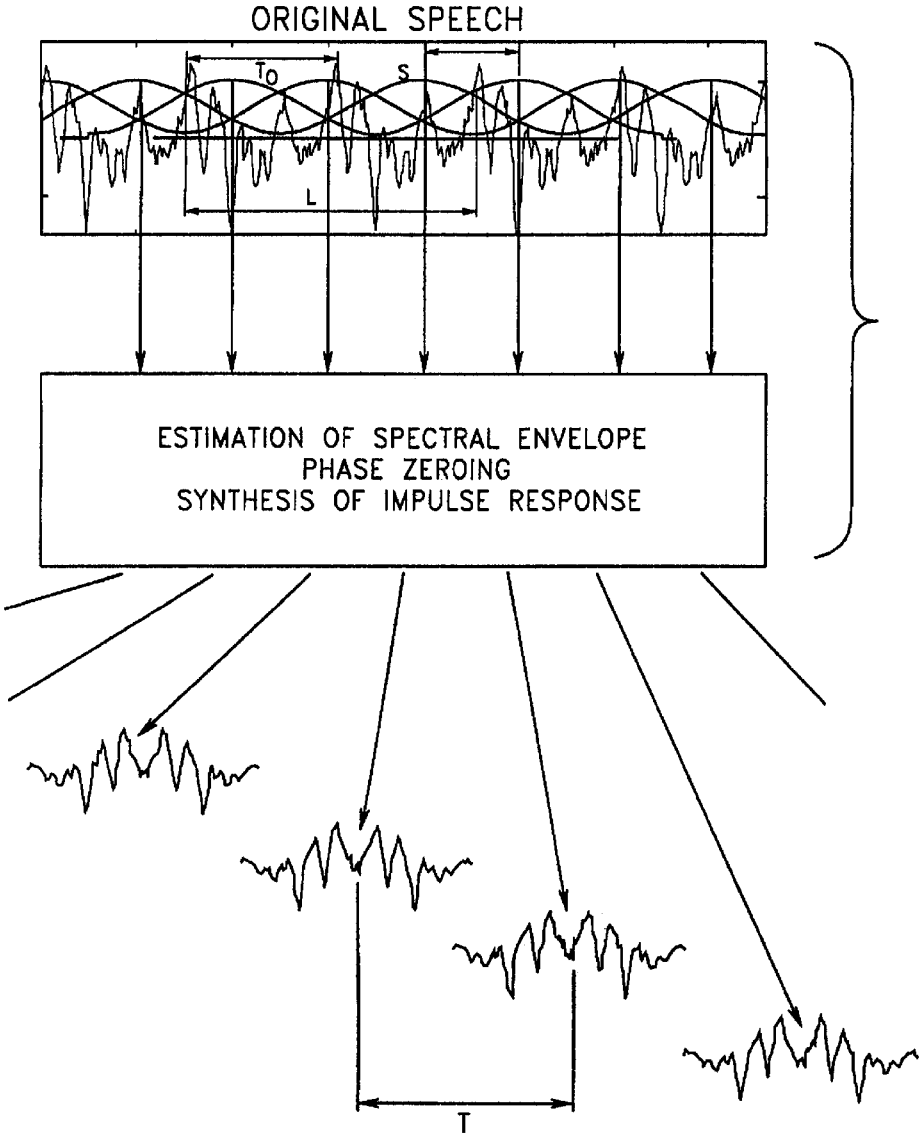
FIG. 2A (PRIOR ART)
Figure 2B:
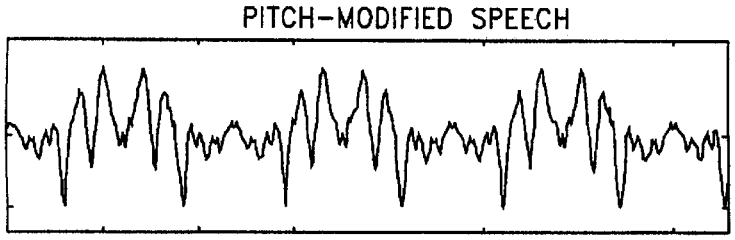
FIG. 2B (PRIOR ART)

FIG. 2 shows the analytic method described by M M. Yazu and Yamada according to the state of the art which implements 3 steps:

1. The original speech is cut out every fixed frame period (hence, not pitch synchronously), and the spectrum of each frames is computed by spectral analysis. Phase components are set to zero, so that only spectral amplitudes are retained. A symmetric waveform is then obtained for each initial frame by inverse FFT. This symmetric waveform is weighted with a fixed length window that decreases to almost zero at its borders.
2. The signals that result from the weighting operation are shifted from each other, the shift being adjusted to the fundamental period of the speech to by synthesized, lower or greater than the original one, following the prosodic information related to the fundamental period at synthesis time.
3. Synthetic speech is obtained by summing these shifted signals.

In this last technique, steps 1 and 2 are often realized once for all, which makes the difference between analytic methods and those based on a spectral model of the vocal tract. The processed waveforms are stored in a database that centralizes, in a purely temporal format, all the information related to the evolution of the spectral envelope of the speech segments.

Figure 3A:
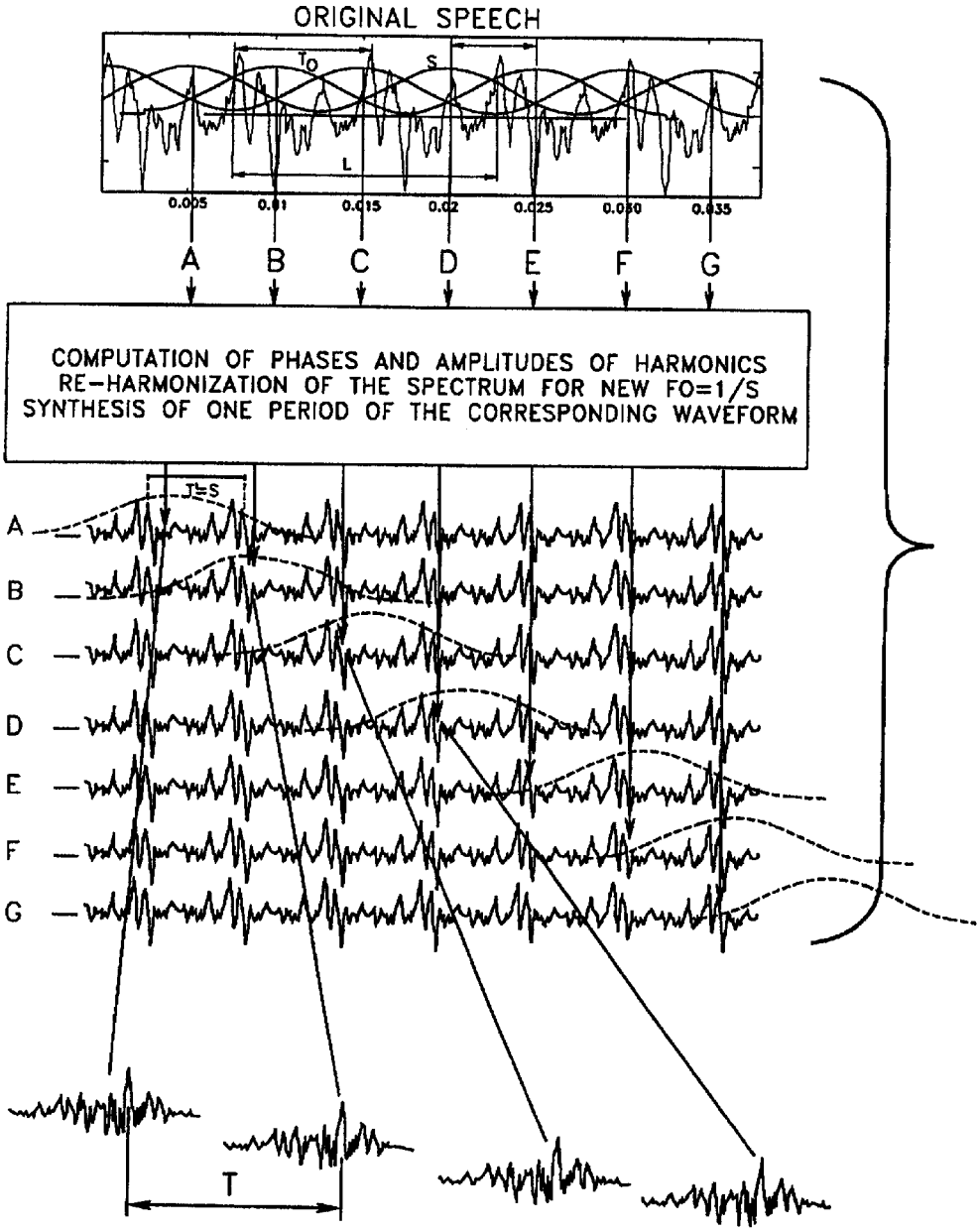
Figure 3B:
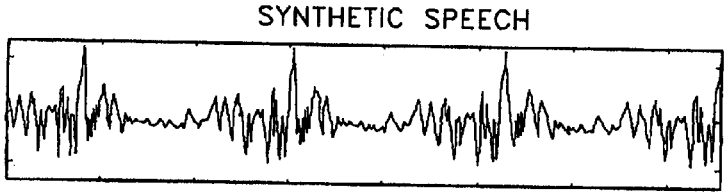

Concerning the preferred implementation of the invention herein described, FIG. 3 describes the following steps:

1. Analysis frames are assigned a fixed length and shift (denoted by S). Instead of estimating the spectral envelope of each analysis frame by cepstral analysis and computing its inverse FFT (as done by M M. Yazu and Yamada), the analysis algorithm of the powerful MBE (Multi-Band Excited) model is used, which computes the frequency, amplitude, and phase of each harmonic of the analysis frame. The spectral envelope is then derived for each frame and the frequencies and amplitudes of harmonics are modified without changing this envelope, so as to obtain a fixed fundamental frequency equal to the analysis shift, S (i.e., the spectrum is "re-harmonized" in the frequency domain). Phases of the lower harmonics are set to a set of fixed values (i.e., a value chosen once for all for a given harmonic number). Time-domain waveforms are then obtained from harmonics by computing a sum of sinusoids, the frequencies, amplitudes, and phases are set equal to those of harmonics. As opposed to the invention of M M. Yazu and Yamada, the waveforms are not symmetrical, as phases have not been set to zero (there was no other choice in the previous method). Furthermore, the precise waveforms obtained are not imposed by the algorithm, as they strongly depend on the fixed phase values imposed before resynthesis. Instead of storing the complete waveform in a segment database, one period of the waveform is only kept, since it is perfectly periodic by construction (sum of harmonics). This period can be looped to obtain the corresponding infinite waveform as required for the next step.

2. On the voiced parts of speech segments, an analysis is performed by weighting the aforementioned re-synthesized waveform (obtained by looping one of its periods computed as a sum of harmonics) with a window with fixed length. The weighting window has a shape that decreases down to zero at its edges, and its length is exactly two times the value of S, and therefore also two times the fundamental period the re-synthesized speech obtained in step 1. One such window is taken from each infinite waveform derived in step 1.
3. The signals that result from the weighting operation are overlapped and shifted from each other, the shift being adjusted to the fundamental period of the speech to be synthesized, lower or greater than S, following the prosodic information related to the fundamental period at synthesis time. Synthetic speech is obtained by summing these shifted signals.

The invention makes it possible to smooth out spectral discontinuities in the time domain due to the fixed set of phases applied to the periods during the resynthesis step for lower-order harmonics, since an interpolation between two such periods in the time-domain is then equivalent to an interpolation in the frequency domain.

We claim:

1. A method for audio synthesis from waveforms stored in a dictionary, comprising the steps of:

the waveforms are infinite and perfectly periodic, and are stored as one of their periods, itself represented as a sequence of sound samples of a priori any length;

a synthesis is carried out by overlapping and adding the waveforms multiplied by a weighting window whose length is approximately two times the period of the original waveform, and whose position relatively to the waveform can be set to any fixed value;

whereby the time shift between two successive weighted signals obtained by weighting the original waveforms is equal to the fundamental period requested for the synthetic signal, whose value is imposed.

2. The method for audio synthesis according to claim 1, wherein the fundamental period of the synthetic signal is greater or lower than the original period in the dictionary.

3. The method for audio synthesis according to claim 2, wherein the lengths of the periods stored in the dictionary are all identical.

4. The method for audio synthesis according to claim 3, wherein the phases of the lower-frequency harmonics (typically from 0 to 3 kHz) of the stored periodic waveforms have a fixed value per harmonic throughout the dictionary.

5. The method for audio synthesis according to claim 4, wherein the stored waveforms are obtained from the spectral analysis of a dictionary of audio signal segments such as diphones in the case of speech synthesis whereby a spectral analysis provides at regular time intervals an estimate of the instantaneous spectral envelope in each segment from which the waveforms are computed.

6. The method for audio synthesis according to claim 3, wherein the stored waveforms are obtained from the spectral analysis of a dictionary of audio signal segments such as diphones in the case of speech synthesis whereby a spectral analysis provides at regular time intervals an estimate of the instantaneous spectral envelope in each segment from which the waveforms are computed.

7. The method for audio synthesis according to claim 2, wherein the stored waveforms are obtained from the spectral analysis of a dictionary of audio signal segments such as diphones in the case of speech synthesis whereby a spectral analysis provides at regular time intervals an estimate of the instantaneous spectral envelope in each segment from which the waveforms are computed.

8. The method for audio synthesis according to claim 1, wherein the lengths of the periods stored in the dictionary are all identical.

9. The method for audio synthesis according to claim 8, wherein the phases of the lower-frequency harmonics (typically from 0 to 3 kHz) of the stored periodic waveforms have a fixed value per harmonic throughout the dictionary.

10. The method for audio synthesis according to claim 9, wherein the stored waveforms are obtained from the spectral analysis of a dictionary of audio signal segments such as diphones in the case of speech synthesis whereby a spectral analysis provides at regular time intervals an estimate of the instantaneous spectral envelope in each segment from which the waveforms are computed.

11. The method for audio synthesis according to claim 8, wherein the stored waveforms are obtained from the spectral analysis of a dictionary of audio signal segments such as diphones in the case of speech synthesis whereby a spectral analysis provides at regular time intervals an estimate of the instantaneous spectral envelope in each segment from which the waveforms are computed.

12. The method for audio synthesis according to claim 1, wherein the stored waveforms are obtained from the spectral analysis of a dictionary of audio signal segments such as diphones in the case of speech synthesis whereby a spectral analysis provides at regular time intervals an estimate of the instantaneous spectral envelope in each segment from which the waveforms are computed.

13. The method for audio synthesis according to any one of the preceding claims, wherein when concatenating two segments, the last periods of the first segment and the first period of the second segment are modified to smooth out the time-domain difference measured between the last period of the first segment and the first period of the second segment, this time-domain difference being added to each modified period with a weighting coefficient varying between −0.5 and 0.5 depending on the position of the modified period with respect to the concatenation point.

14. A method for audio synthesis from waveforms stored in a dictionary, comprising;

the waveforms are infinite and perfectly periodic and are obtained from the spectral analysis of a dictionary of audio signal segments, and are stored as one of their periods, itself represented as a sequence of sound samples of a priori any length;

a synthesis is carried out by overlapping and adding the waveforms multiplied by awaiting window whose length is approximately two times the period of the original waveform, and whose position relative to the waveform can be set at any fixed value;

whereby the time shift between two successive weighted signals obtained by weighting the original waveforms is equal to the fundamental period requested for the synthetic signal whose value is imposed;

wherein when concatenating two segments, the last period of the first segment and the first period of the second segment are modified to smooth out the time-domain difference measured between the last period of the first segment and the first period of the second segment, this time-domain difference being added to each modified period with a weighting coefficient varying between −0.5 and 0.5 depending on the position of the modified period with respect to the concatenation point, and for each base segment, replacement segments are stored whereby at synthesis time when two segments are about to be concatenated, the periods of the first base segment are modified so as to propagate, on the last periods of this segment, the difference between the last period of the base segment and the last period of one of its replacement segments and whereby the periods of the second base segment are modified so as to propagate, on the first periods of this segment, the difference between the first period of the base segment and the first period of one of its replacement segments, the propagation of these differences being performed by multiplying the measured differences by a weighting coefficient continuously varying from one to zero (from period to period) and adding the weighted differences to the periods of the base segments.

* * * * *

UNITED STATES PATENT AND TRADEMARK OFFICE

CERTIFICATE OF CORRECTION

PATENT NO. : 5,987,413
DATED : November 16,1999
INVENTOR(S) : Dutoit, et al.

It is certified that error appears in the above-identified patent and that said Letters Patent is hereby corrected as shown below:

Title page, item [30] insert - Foreign Application Priority Data
June 10, 1996 BE Pat. Off.....09600524

Signed and Sealed this

Nineteenth Day of June, 2001

*Attest:*

Nicholas P. Godici

*Attesting Officer*

NICHOLAS P. GODICI
*Acting Director of the United States Patent and Trademark Office*